US007134746B2

(12) United States Patent
Takahashi

(10) Patent No.: US 7,134,746 B2
(45) Date of Patent: Nov. 14, 2006

(54) PIEZOELECTRIC TRANSDUCER FOR USE IN INK EJECTOR AND METHOD OF MANUFACTURING THE PIEZOELECTRIC TRANSDUCER

(75) Inventor: Yoshikazu Takahashi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/888,124

(22) Filed: Jul. 9, 2004

(65) Prior Publication Data

US 2004/0246315 A1 Dec. 9, 2004

Related U.S. Application Data

(62) Division of application No. 10/351,788, filed on Jan. 27, 2003, now Pat. No. 6,993,812.

(30) Foreign Application Priority Data

Feb. 5, 2002 (JP) ..... 2002-028286

(51) Int. Cl.
*B41J 2/045* (2006.01)
*B41J 29/393* (2006.01)

(52) U.S. Cl. ..... 347/72; 347/19; 347/69

(58) Field of Classification Search ..... 264/436; 310/359, 333–337; 347/68–72, 19
See application file for complete search history.

(56) References Cited

U.S. PATENT DOCUMENTS 4,704,675 A * 11/1987 Jacobs et al. ..... 347/14
5,402,159 A 3/1995 Takahashi et al.
5,923,352 A 7/1999 Kikuchi et al.

FOREIGN PATENT DOCUMENTS

| | | |
|---|---|---|
| JP | 9-300636 | 11/1997 |
| JP | 1038476 | 5/1998 |
| JP | 2000-103056 | 4/2000 |

* cited by examiner

*Primary Examiner*—Stephen Meier
*Assistant Examiner*—Geoffrey S. Mruk
(74) *Attorney, Agent, or Firm*—Reed Smith LLP

(57) ABSTRACT

Inner individual electrodes are formed at intervals on a piezoelectric ceramic layer so as to correspond in a one-to-one relationship with ink channels, and an inner common electrode are formed on another piezoelectric ceramic layer. The required number of piezoelectric ceramic layers with inner individual electrodes and with an inner common electrode are laminated alternately. An outer common electrode is connected to the inner common electrodes, and outer individual electrodes are connected to the respective inner individual electrodes. The capacitance between the outer common electrode and each of the outer individual electrodes is measured. A polarization electric field adjusted based on the measured value is applied between the common electrode and each of the outer individual electrodes to perform polarization. As a result, each area defined over an ink channel by the stacked inner individual and common electrodes is polarized so as to be deformed by a uniform amount when a constant drive voltage is used.

13 Claims, 14 Drawing Sheets

PIEZOELECTRIC TRANSDUCER FOR USE IN INK EJECTOR AND METHOD OF MANUFACTURING THE PIEZOELECTRIC TRANSDUCER

CROSS REFERENCE TO RELATED APPLICATIONS

This is a divisional of application Ser. No. 10/351,788 filed on Jan. 27, 2003 now U.S. Pat. No. 6,293,812, which is currently before the United States Patent and Trademark Office.

BACKGROUND OF THE INVENTION

1. Field of Invention

The invention relates to a piezoelectric transducer for use in an ink ejector and relates to a method of manufacturing the piezoelectric transducer.

2. Description of Related Art

A piezoelectric ink ejecting mechanism has been conventionally proposed for a printhead. In a drop-on-demand ink ejecting mechanism, a piezoelectric transducer deforms to change the volume of an ink channel containing ink. Ink in the ink channel is ejected from a nozzle when the volume is reduced, while ink is drawn into the ink channel when the volume is increased.

A single piezoelectric transducer having a plurality of ink ejecting mechanisms and disposed across a plurality of ink channels has recently been proposed for a piezoelectric ink ejector. A portion of the piezoelectric transducer corresponding to a particular ink ejecting mechanism is locally deformed. Such a piezoelectric transducer is disclosed in U.S. Pat. No. 5,402,159. The structure and the manufacturing method of the piezoelectric transducer disclosed in that patent will be described below.

As shown in FIG. 12, a piezoelectric transducer 38 is made of ceramic green sheets 40. Inner individual electrodes 44 are formed on a ceramic green sheet by screen printing, and an inner common electrode 42 and its lead are formed by screen printing on another ceramic green sheet. The required number of ceramic green sheets with inner individual electrodes and with an inner common electrode are laminated alternately, and another green sheet without electrodes is laminated on the top. The laminated ceramic green sheets 40 are thermally pressed, degreased, and sintered as required. Then, an outer common electrode 52 is attached to the leads of the inner common electrodes 42, while outer individual electrodes 54 are attached to the exposed portions of the inner individual electrodes 44.

Thereafter, the piezoelectric transducer 38 thus obtained is immersed in an oil bath filled with an insulating oil, such as a silicon oil, heated to a temperature of about 130° C., and the piezoelectric transducer 38 undergoes polarization. An electric field of about 2.5 kV/mm is applied by a polarizing power source 56 to the outer common electrode 52 and the outer individual electrodes 54. As a result, polarization electric fields are generated at those areas of the ceramic sheets 40 that are sandwiched between the inner individual electrodes 44 and the inner common electrodes 42, and these areas are polarized. The piezoelectric transducer 38 is attached across a plurality of ink channels such that the inner individual electrodes 44 on each ceramic sheet 40 correspond in a one-to-one relationship to the ink channels. Each of the polarized areas, provided over an ink channel, will be deformed when a drive voltage is applied thereto.

Because the piezoelectric transducer 38 is manufactured by unitarily pressing and sintering the ceramic green sheets 40 formed with inner electrodes 42, 44, the ceramic green sheets 40 are likely to vary in thickness among piezoelectric transducers manufactured, or the inner individual electrodes 44 are likely to vary in area in a piezoelectric transducer manufactured.

By the conventional method, however, the same polarization voltage is applied to all the areas to be deformed of the piezoelectric transducer 38, regardless of variations in finished dimensions of the individual electrodes 44 and the ceramic sheets 40. Thus, the areas to be deformed are polarized to have different piezoelectric characteristics, and when a constant drive voltage is applied to the areas to be deformed, these areas are deformed by different amounts and an ink droplet is ejected at different velocities from the corresponding ink channels.

The forgoing problems could be solved, for example, by changing the drive voltage for each area to be deformed, but this method would increase the costs of a power source or a driving circuit board.

SUMMARY OF THE INVENTION

The present invention addresses the forgoing problems and provides a piezoelectric transducer for use in an ink ejector, in which areas to be deformed are deformed by a substantially uniform amount and an ink droplet is ejected at a substantially uniform velocity even when a constant drive voltage is applied to all the areas to be deformed, thereby accomplishing high-quality printing.

According to one aspect of the invention, a piezoelectric transducer is manufactured by the following steps. A plurality of sets of electrodes are formed in a plurality of piezoelectric ceramic layers, at predetermined intervals, in a direction along a plane of the piezoelectric ceramic layers. Each set of electrodes includes electrodes spaced in a thickness direction of the piezoelectric ceramic layers, and each set of electrodes defines an area to be deformed. The capacitance of each area to be deformed is measured. Then, each area to be deformed is polarized by adjusting a polarization condition based on the measured capacitance.

According to another aspect of the invention, a piezoelectric transducer is manufactured by the following steps. A plurality of sets of electrodes are formed in a plurality of piezoelectric ceramic layers, at predetermined intervals, in a direction along a plane of the piezoelectric ceramic layers. Each set of electrodes includes electrodes spaced in a thickness direction of the piezoelectric ceramic layers, and adjacent sets of electrodes each define therebetween an area to be deformed. The capacitance of each area to be deformed is measured. Then, each area to be deformed is polarized by adjusting a polarization condition based on the measured capacitance.

In the above manufacturing methods, a polarization electric field to be applied to an area to be deformed is adjusted, as the polarization condition, in inverse proportion to the measured capacitance such that the polarization electric field is weakened when the measured capacitance of the area to be deformed is great and the polarization electric field is intensified when the measured capacitance of the area to be deformed is small.

As a result, each area to be deformed is polarized so as to be deformed by a substantially uniform amount when a constant drive voltage is applied thereto.

According to another aspect of the invention, a piezoelectric transducer manufactured by either of the above methods is incorporated into an ink ejector. Piezoelectric ceramic layers of the piezoelectric transducer are attached across a plurality of ink channels such that each area to be deformed is provided over a corresponding ink channel.

In the ink ejector, when a constant drive voltage is applied to each area to be deformed, each area to be deformed is deformed by a substantially uniform amount, and ink is ejected at a substantially uniform velocity from a corresponding ink channel.

According to another aspect of the invention, an ink ejector comprising a plurality of ink channels and a piezoelectric transducer overlying the channels is provided. The transducer has one or more piezoelectric ceramic layers overlying the ink channels and the layers include a plurality of deformable areas which are associated with the ink channels. The transducer further includes sets of electrodes in the ceramic layers which are used to deform the deformable areas to eject ink. Each set of electrodes has at least one positive electrode for applying a positive drive voltage and at least one reference electrode for applying a reference drive voltage. The area between the positive and reference electrodes define an associated deformable area. According to the principles of the present invention, the extent of polarization for each of the deformable areas depends on individually measured capacitance of the each deformable area. That way, each deformable area is deformed by a substantially uniform amount, thereby ejecting ink at a substantially uniform velocity from different ink channels, even when substantial variations exist in the size of electrodes and thickness of the ceramic layers over different ink channels.

BRIEF DESCRIPTION OF THE DRAWINGS

Preferred embodiments of the invention will be described in detail with reference to the following figures, in which like elements are labeled with like numbers and the figures are not drawn to scale and in which.

DETAILED DESCRIPTION OF PREFERRED EMBODIMENTS

A piezoelectric transducer, an ink ejector, and an ink-jet printer according to a first embodiment will be described with reference to FIGS. 1 through 3.

Figure 1:
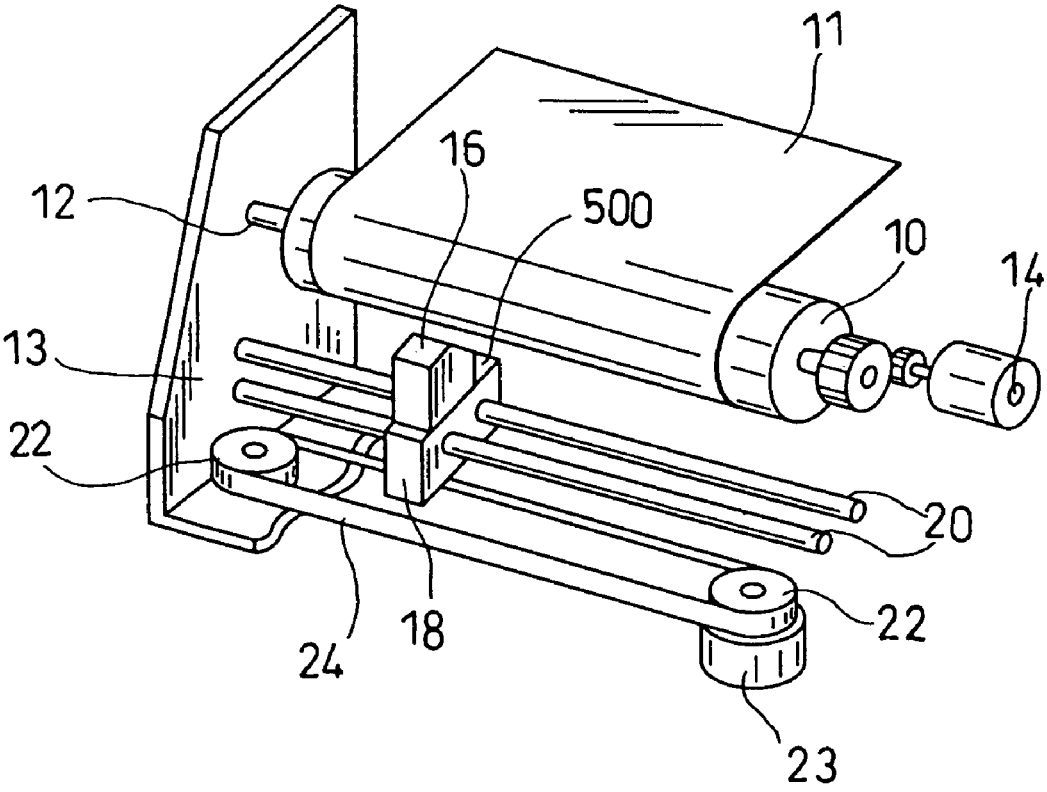
FIG. 1 is a perspective view of an ink-jet printer incorporating an ink ejector according to a first embodiment of the invention.

FIG. 1 is a perspective view showing substantial elements of an ink-jet printer incorporating an ink ejector 500 of the first embodiment. A platen 10 is rotatably attached to a frame 13 via a shaft 12 and is driven by a motor 14. An ink ejector 500, which will be described later herein, is disposed to face the platen 10. The ink ejector 500 is mounted on a carriage 18 together with an ink source 16. The carriage 18 is slidably held by two guide rods 20 disposed parallel to the axis of the platen 10, and is connected to a timing belt 24 attached around a pair of pulleys 22. The motor 23 rotates one of the pulleys 22 to feed the timing belt, thereby moving the carriage along the platen 10.

Figure 2:
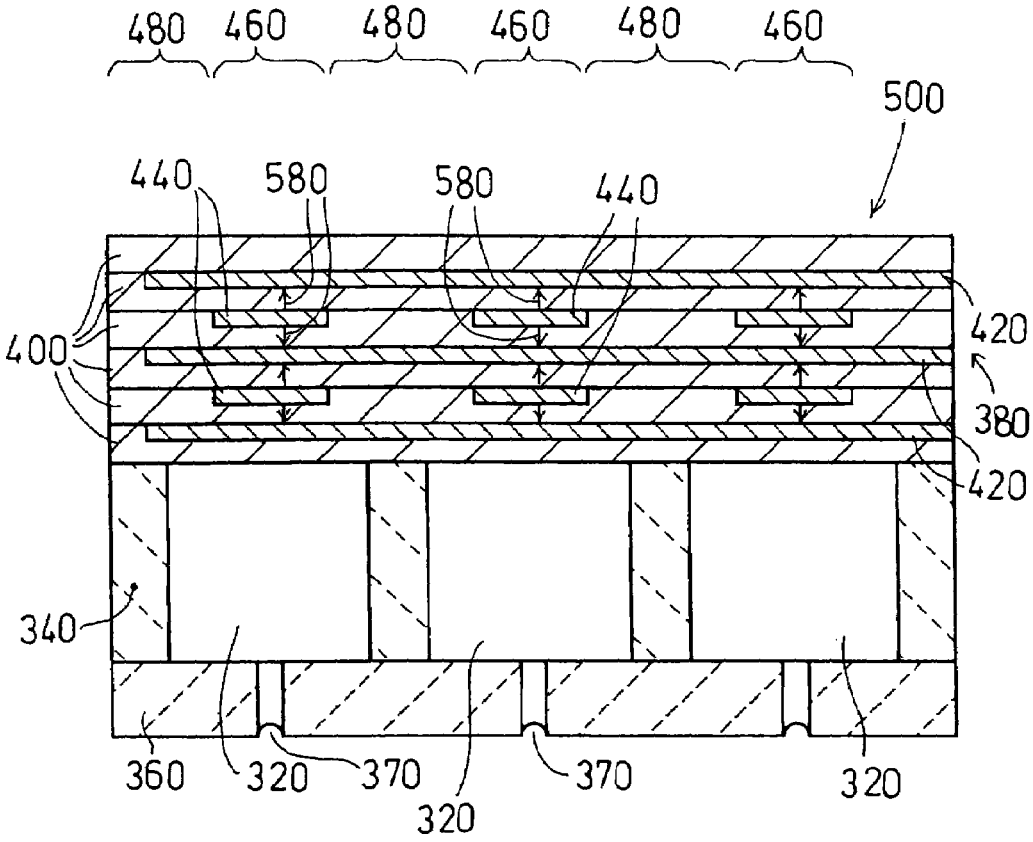
FIG. 2 is a sectional view of the ink ejector according to the first embodiment.

FIG. 2 is a sectional view of the ink ejector 500. The ink ejector 500 includes an ink channel member 340, which is a rectangular box open at the top and bottom and formed with a plurality of ink channels 320, a nozzle plate 360 formed with nozzles and attached to the bottom of the ink channel member 340, and a piezoelectric transducer 380 attached to the top of the ink channel member 304. Each ink channel 320 is 0.3 mm in width and 3.8 mm in length. The ink channels 320 and the nozzles 370 are arranged with 0.339 mm pitches (about 75 dpi). A total of 75 ink channels 320 are formed in the ink channel member 340, although only three ink channels 320 are shown in FIG. 2.

The piezoelectric transducer 380 is formed to a thickness of 0.25 mm by laminating a plurality of piezoelectric ceramic layers 400 while sandwiching inner common electrodes 420 and inner individual electrodes 440 alternately therebetween. Inner individual electrodes 440 are spaced on the piezoelectric ceramic layer 400 in a one-to-one correspondence with the ink channels 320. The piezoelectric transducer 380 has active areas 460 that are sandwiched between the inner common electrodes 420 and the inner individual electrodes 440, and inactive areas 480 that are not sandwiched between the inner common electrodes 420 and the inner individual electrodes 440. Each piezoelectric ceramic layer 400 has a thickness of 0.04 mm and is made of a piezoelectric ceramic material of lead zirconate titanate (PZT) group that has ferroelectricity. Each piezoelectric ceramic layer 400 except the top and bottom layers is polarized in the laminating direction. The active areas 460 are equal in width to the inner individual electrodes 440. The inner common electrodes 420 and the inner individual electrodes 440 are made of a metal of Ag-Pg group and have a thickness of 0.002 mm.

The piezoelectric transducer 380 is fixed to the ink channel member 340 at the inactive areas 480.

In the piezoelectric transducer 30, a plurality of sets of electrodes are provided along a plane of the piezoelectric ceramic layers 400, and a set of electrodes is provided over each ink channel 320. A set of electrodes includes inner common electrodes 420 and inner individual electrodes 440 that are spaced in the thickness direction of the piezoelectric ceramic layers 400. Upon application of a drive voltage between the inner common electrodes 420 and the inner individual electrodes 440 of a set of electrodes, an active area 460 defined by the set of electrodes is deformed in the thickness direction by a piezoelectric longitudinal effect. Hereinafter, it is to be understood that the term "active area" as used herein refers to both an area polarized and an area to be polarized so as to be deformed when a drive voltage is applied thereto.

The piezoelectric transducer 380 according to the first embodiment is manufactured as described below.

Figure 3:
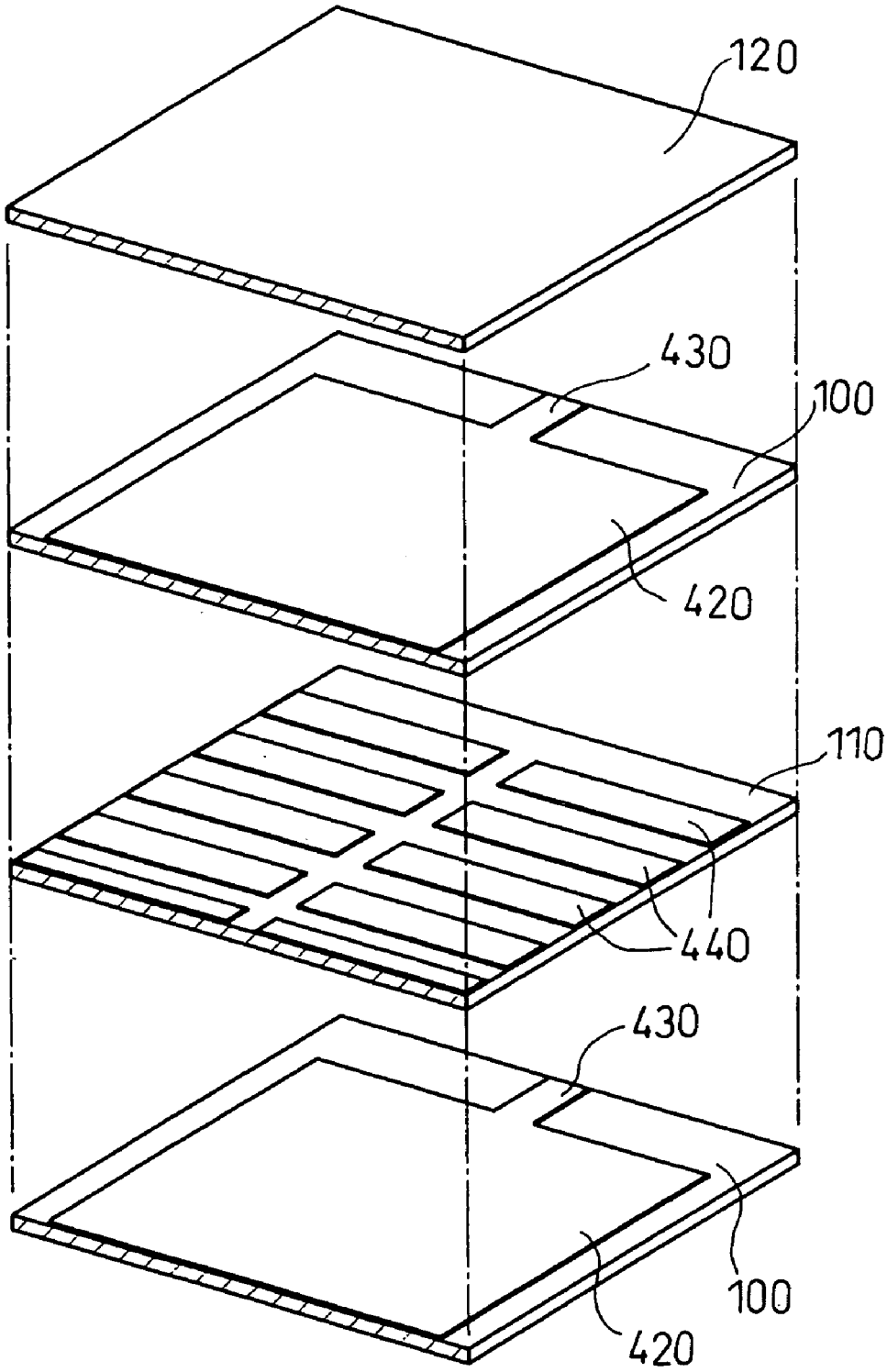
FIG. 3 is a perspective view of ceramic green sheets that shows the manufacturing process of a piezoelectric transducer according to the first embodiment.

As shown in FIG. 3, a plurality of inner individual electrodes 440 are formed by screen-printing on a upper surface of a ceramic green sheet 110 so as to correspond to the ink channels 320 in a one-to-one relationship. An inner common electrode 420 and an electrode lead 430 are formed by screen-printing on an upper surface of another green sheet 100. Then, the required number of green sheets 100, 110 are laminated alternately, and a green sheet 120 without electrodes is laminated on the top. The laminated green sheets are thermally pressed, degreased, and sintered as required. As a result, the piezoelectric transducer 380 is obtained.

Figure 4:
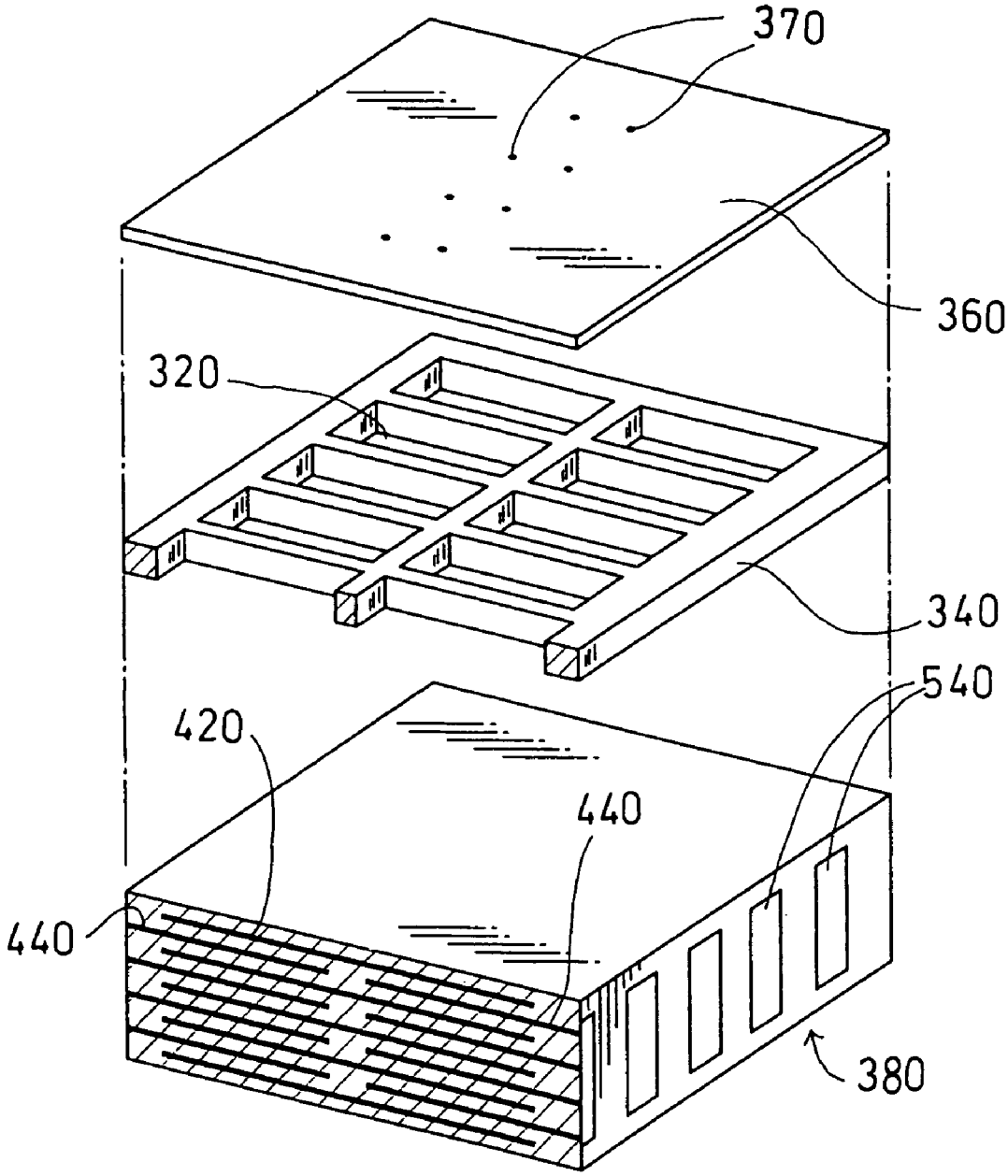
FIG. 4 is a perspective view of the piezoelectric transducer assembled into the ink ejector according to the first embodiment.
Figure 5:
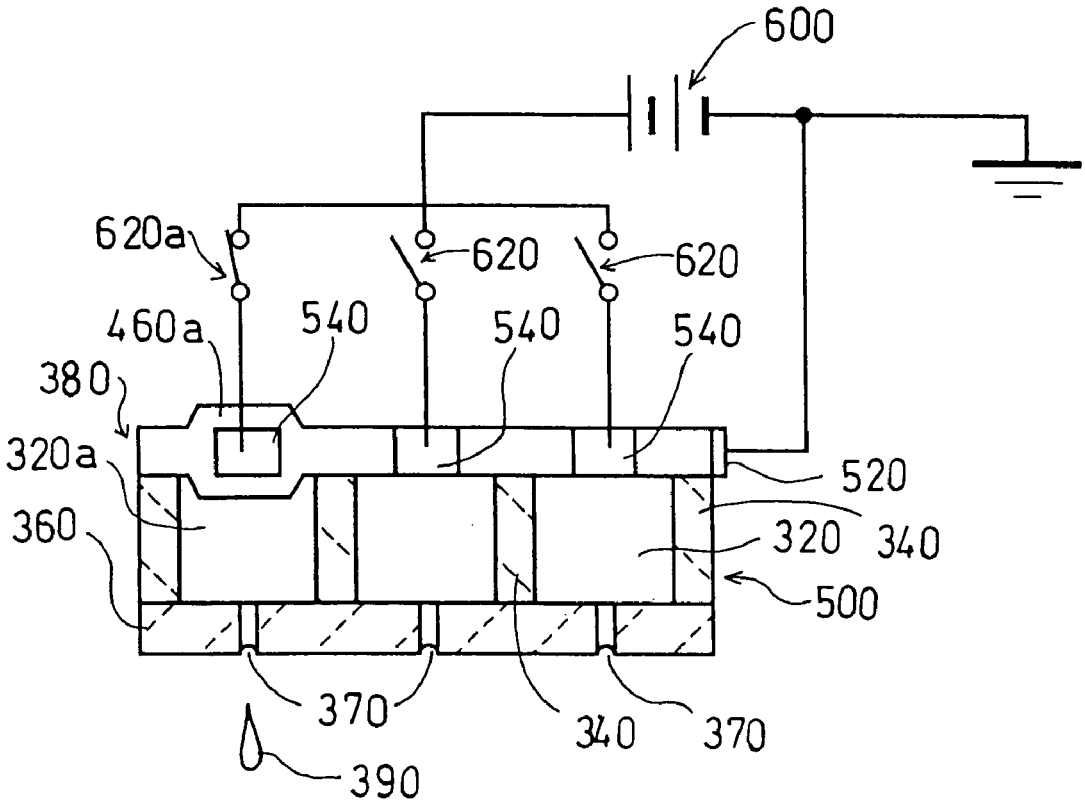
FIG. 5 is a schematic view showing the operation of the ink ejector according to the first embodiment, where the piezoelectric transducer is locally deformed to eject ink.

Then, as shown in FIGS. 4 and 5, an outer common electrode 520 is attached to the electrode leads 430, and outer individual electrodes 540 are attached to the exposed portions of the inner individual electrodes 440.

Figure 6A:
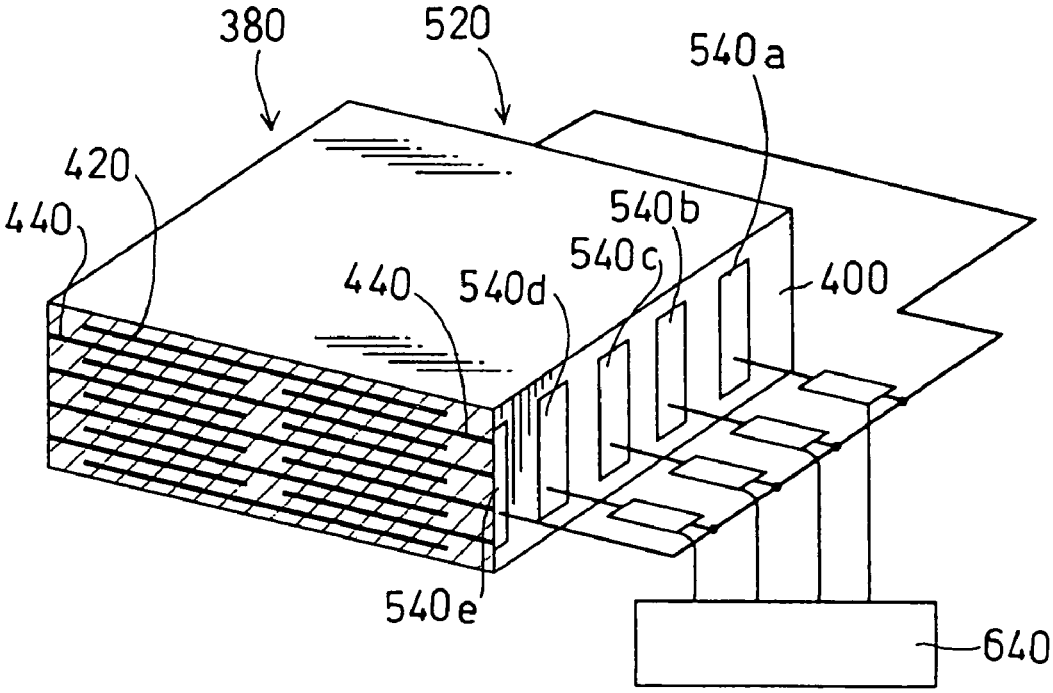
FIGS. 6A and 6B show perspective views of the piezoelectric transducer according to the first embodiment, FIG. 6A showing the process of measuring the capacitance of the piezoelectric transducer before polarization, and FIG. 6B showing the polarization process.

Then, the capacitance of an active area 460 (area to be deformed by a piezoelectric longitudinal effect) provided for each ink channel 320 is measured individually. The capacitance herein refers to the capacitance measured after the green sheets have been sintered but not yet been polarized. As shown in FIG. 6A, the capacitance between the outer common electrode 520 and each outer individual electrode 540*a*, 540*b*, 540*c*, 540*d*, 540*e* is measured using a capacitance measuring device 640, such as an inductance-capacitance-resistance measuring meter, at a low voltage of 1 V and at a low frequency of 1 kHz, for example.

Figure 7:
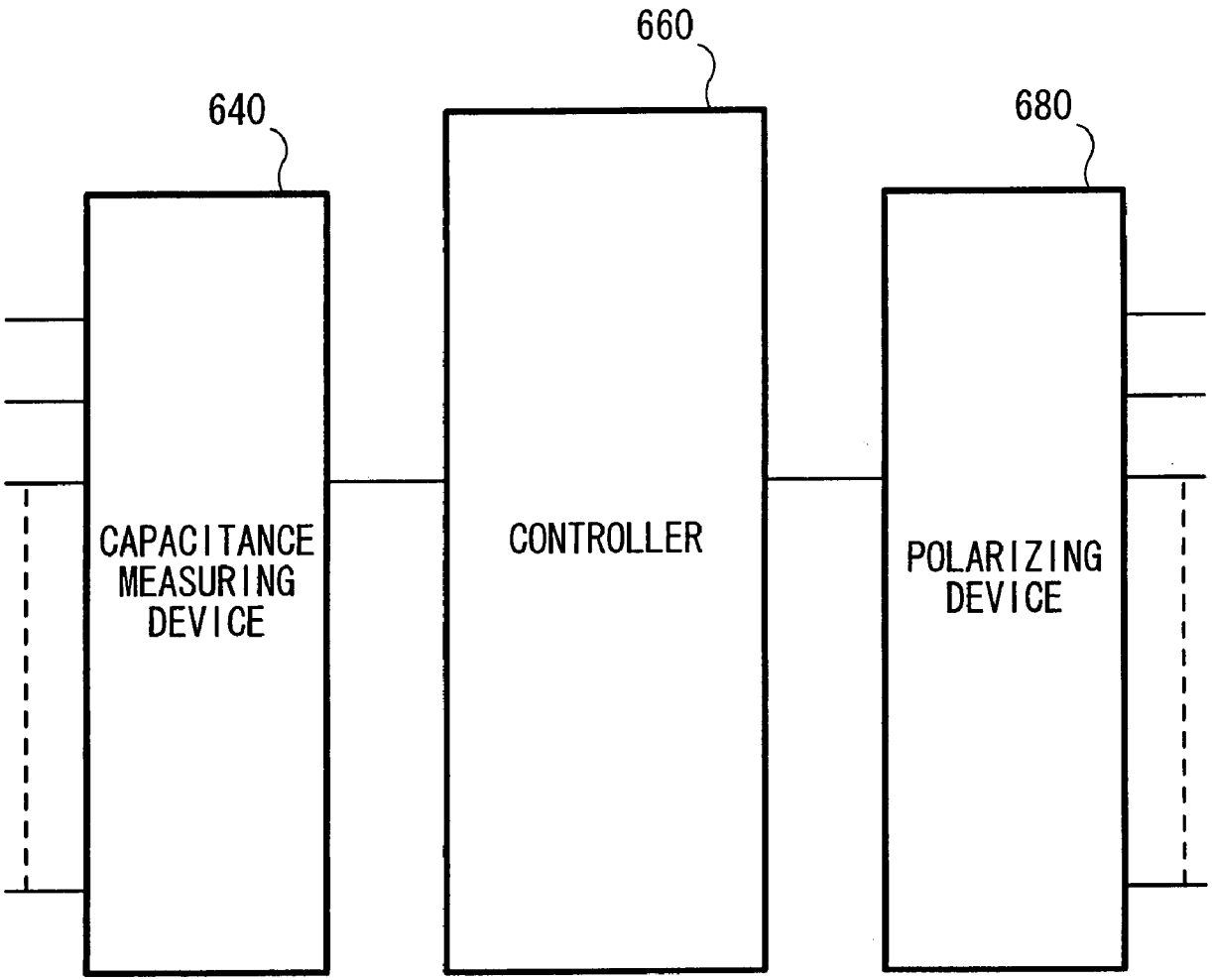
FIG. 7 is a block diagram showing a capacitance measuring device, controller, and polarizing device.

The measured capacitance of each outer individual electrodes 540*a*, 540*b*, 540*c*, 540*d*, 540*e*, which corresponds to an active area 460 provided for each ink channel, is stored in a memory (not shown), such as a RAM of a controller 660 shown in FIG. 7.

In the piezoelectric transducer 38, the capacitance of each active area 460, defined in the ceramic sheets 40 by a set of electrodes including stacked inner individual and common electrodes 44, 42, is proportional to the product of the width and length (the area) of the inner individual electrodes 44 and proportional to the inverse of the thickness of a ceramic sheet 40. In this embodiment, the area of the inner electrodes 44, 42 that serve as condenser is four times larger than the area of a single inner individual electrode.

Figure 8:
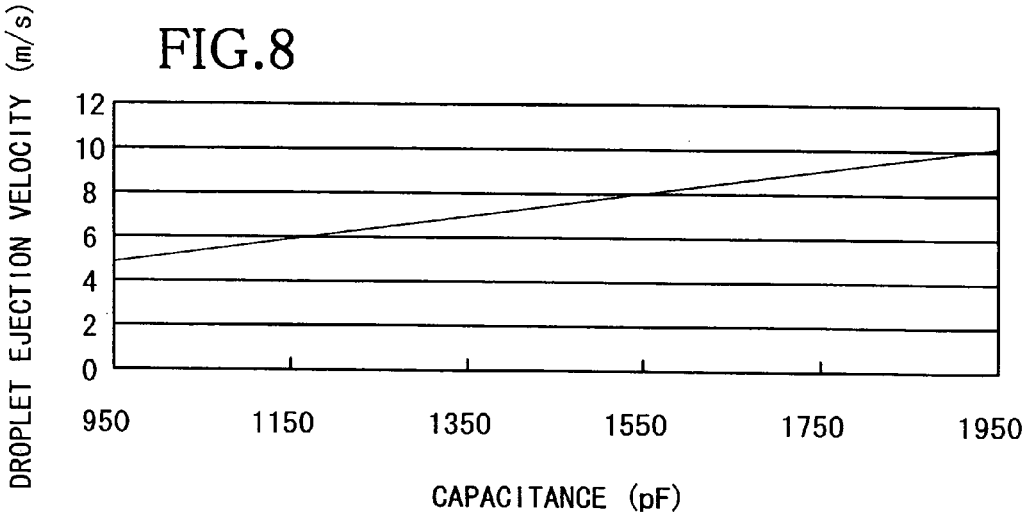
FIG. 8 is a graph showing the relationship between the capacitance and the droplet ejection velocity of a piezoelectric transducer polarized by a conventional method.

FIG. 8 is a graph obtained by an experiment and shows the relationship between the capacitance and the droplet ejection velocity in a piezoelectric transducer polarized by a conventional method where all the active areas are polarized using the same polarization voltage. It is found that when the drive voltage is constant, the velocity of an ink droplet ejected from each ink channel is proportional to the capacitance of a corresponding active area. More specifically, as shown in FIG. 8, when the capacitance changed from 950 pF (picofarad) to 1950 pF, the droplet ejection velocity increased from 5 m/sec to 10 m/sec. Therefore, if active areas vary in capacitance before polarization and are polarized using the same polarization voltage, an ink droplet is ejected at different velocities from different ink channels when the constant drive voltage is applied to the active areas after polarization. An ink droplet is ejected at a higher velocity from an ink channel associated with a higher-capacitance area than from an ink channel associated with a lower-capacitance area.

In this embodiment, the piezoelectric transducer 380 is polarized, as described below, considering the variations in capacitance among the active areas 460 to make the amount of deformation of each active area 460 and the ink droplet ejection velocity uniform.

The piezoelectric transducer 380 is immersed in an oil bath filled with an insulating oil, such as a silicon oil, heated to a temperature of about 130° C., and polarization is performed for the piezoelectric transducer 380 immersed in the oil bath.

Figure 6B:
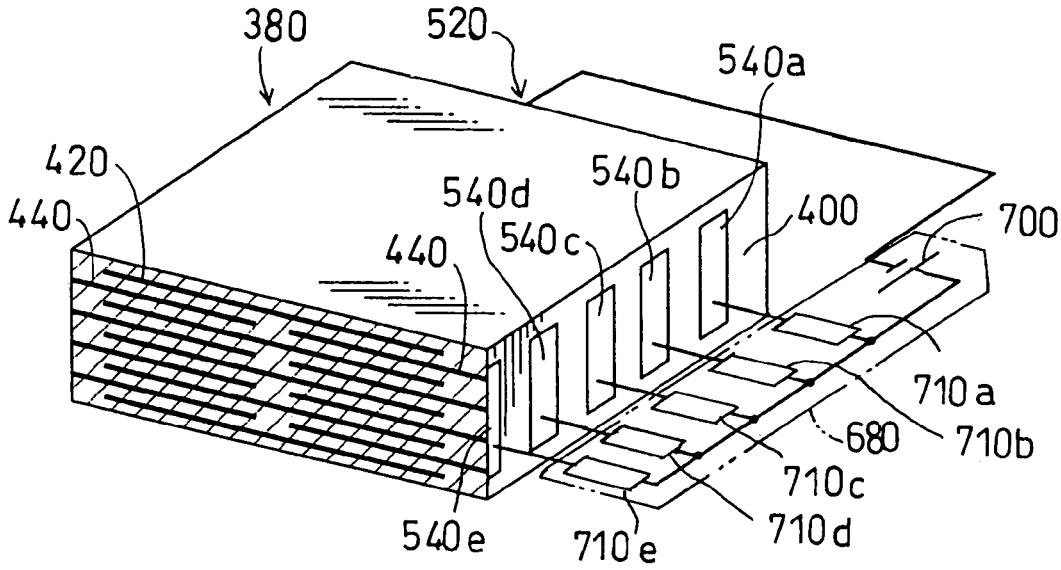

In this case, the polarization condition for each active area 460 is adjusted by a polarizing device 680 based on the measured capacitance. By way of example, as shown in FIG. 6B, the outer common electrode 520 of the piezoelectric transducer 380 to be polarized is connected to a negative pole of a common drive voltage source 700 while the outer individual electrodes 540*a*–540*e* are connected to a positive pole of the common drive voltage source 700, via polarization voltage adjusters 710*a*–710*e*. In this way, the polarization voltage is increased or reduced based on the measured capacitance.

Figure 9:
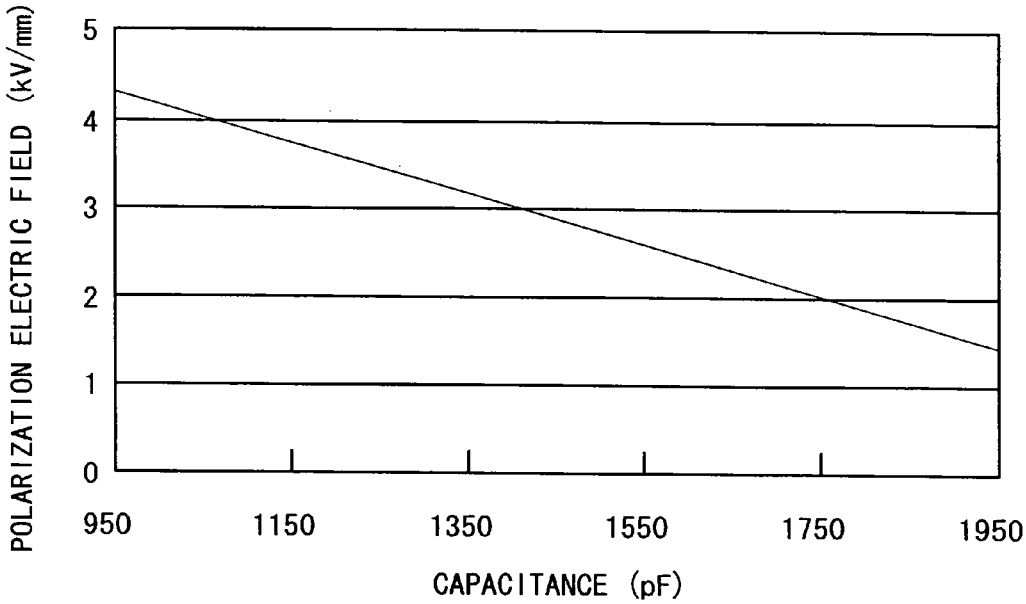
FIG. 9 is a graph showing the relationship between the capacitance and the polarization electric field of the piezoelectric transducer of the first embodiment.

A data map or an expression representing the relationship between the capacitance and the polarization voltage, obtained from a graph shown in FIG. 9, is previously stored in the controller 660. The polarization voltage to be applied is determined by a predetermined computation, and the adjusters 710*a*–710*e* are controlled accordingly.

In FIG. 9, the horizontal axis indicates the capacitance (unit: pF) measured after the green sheets have been sintered, and the vertical axis indicates the polarization electric field (unit: kV/mm) with which the active areas 460 are polarized in relation to the capacitance so as to be deformed by a uniform amount when a constant drive voltage is applied thereto. The relationship between the capacitance and the polarization electric field, shown in FIG. 9, was obtained by experiment. FIG. 9 indicates that if the active areas 460 of the piezoelectric transducer 380 are polarized by adjusting the polarization electric field in inverse proportion to the capacitance, that is, by increasing the polarization electric field when the capacitance of an active area 460 is low and by reducing the polarization electric field when the capacitance of an active area 460 is high, the polarized active areas 460 are deformed by a substantially uniform amount. Accordingly, when the piezoelectric transducer 380 is incorporated into an ink ejector, an ink droplet is ejected at a substantially uniform velocity from the ink channels 320. As a result, uniform and high quality printing is accomplished. The intensity of the polarization electric field is determined by the intensity of the polarization voltage and the length of the polarization voltage applying time. Thus, the polarizing condition can be changed and adjusted by changing at least one of the polarization voltage or the polarization voltage applying time.

When the piezoelectric ceramic layers 400 are polarized, electric fields are generated, as shown by arrows 580 in FIG. 2, in the piezoelectric ceramic layers 400 from the inner individual electrodes 440 toward the inner common electrodes 420. Further, by the above-described polarization method, the active areas 460 of the piezoelectric transducer 380 are polarized individually to different polarization states.

As shown in FIGS. 2 and 4, the piezoelectric transducer 380 thus obtained is assembled with the ink channel member 340 and the nozzle plate 360 into the ink ejector 300. The ink ejector 300 is driven by an electric driving circuit shown in FIG. 5. In this electric circuit, a negative pole of a driving power source 600, which has a predetermined single voltage, and the outer common electrode 520 of the piezoelectric transducer 380 are grounded while a positive pole of the driving power source 600 is connected, via switches 620, to the outer individual electrodes 540 of the piezoelectric transducer 380. The switches 620 are selectively closed by a controller (not shown), and the driving power source 600 applies the predetermined single voltage, as a drive voltage, between the inner common electrodes 420 and the inner individual electrodes 440 located at a selected active area 460.

For example, when a switch 620*a* is closed by the controller according to predetermined print data, a voltage is applied between the inner common electrodes 420 and the inner individual electrodes 440 of an active area 460*a*, and electric fields parallel to the polarization directions shown by arrows 580 (FIG. 2) are applied to the piezoelectric ceramic layers 400 defined therebetween. The active area 460*a* expands vertically as shown in FIG. 5 by a piezoelectric/electrostrictive longitudinal effect to reduce the volume of an ink channel 320*a*. As a result, an ink droplet 390 is ejected from the ink channel 320*a* through a nozzle 370*a*. When the switch 620*a* is opened to stop the application of the drive voltage, the active area 460*a* returns to the original position. As the volume of the ink channel 320*a* increases, ink is supplied to the ink channel 320*a* from the ink source 16.

Comparisons were made between variations in the droplet ejection velocity in the ink ejector manufactured by the conventional method and variations in the droplet ejection velocity in the ink ejector according to the first embodiment. In the conventional ink ejector, the lowest droplet ejection velocity was 5.3 m/s and the highest droplet ejection velocity was 9.7 m/s, and the difference between the two velocities was as great as 4.4 m/s. In contrast, in the ink ejector according to the first embodiment, the lowest droplet ejection velocity was 7.6 m/s and the highest droplet ejection velocity was 8.3 m/s, and the difference between the two velocities was only 0.7 m/s. The range of velocity variations of the ink ejector according to the first embodiment were reduced to approximately one-tenth that of the conventional ink ejector.

Consequently, the droplet velocities can be made substantially uniform throughout the ink channels 320. This also enables production of piezoelectric transducers 380 that have a substantially uniform droplet velocity throughout a plurality of ink channels. The ink ejector 300 incorporating such a piezoelectric transducer 380 can accomplish uniform and high quality printing. Because there is no need to change the drive voltage for each active area 460 over an ink channel 320, the costs of a power source or a driving circuit board can be reduced.

Figure 10A:
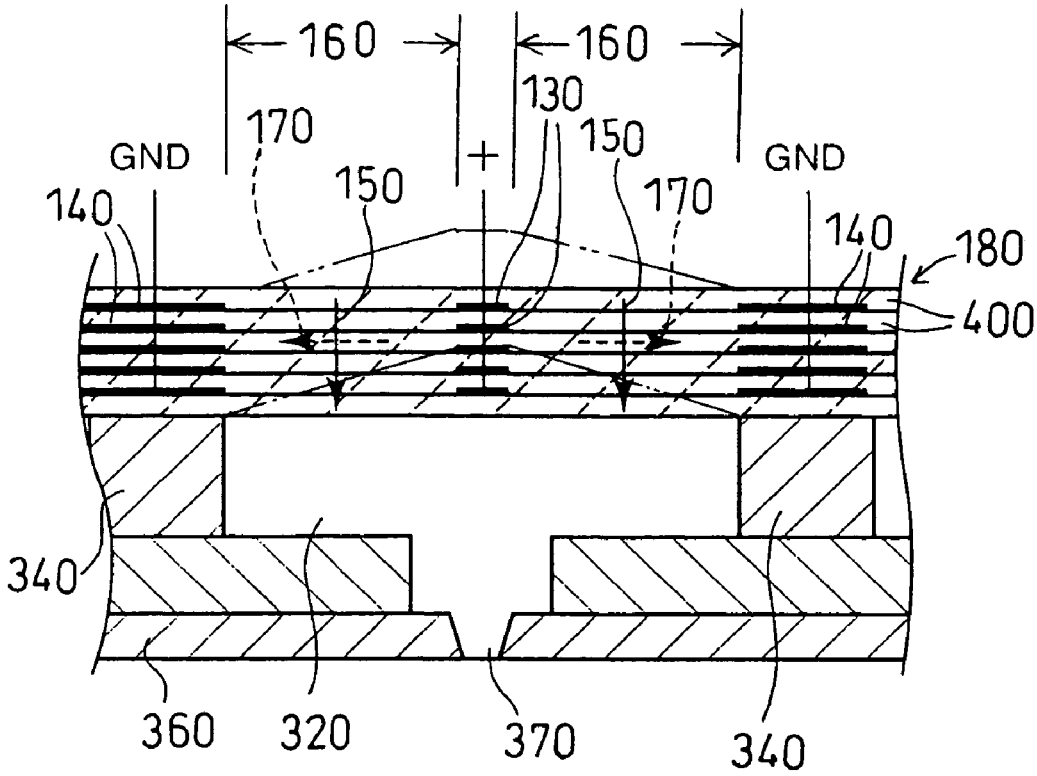
FIGS. 10A, 10B, and 10C show a second embodiment of the invention, FIG. 10A being a sectional view of an ink ejector, FIG. 10B showing the process of measuring the capacitance before polarization, and FIG. 10C showing the polarization process.
Figure 10B:
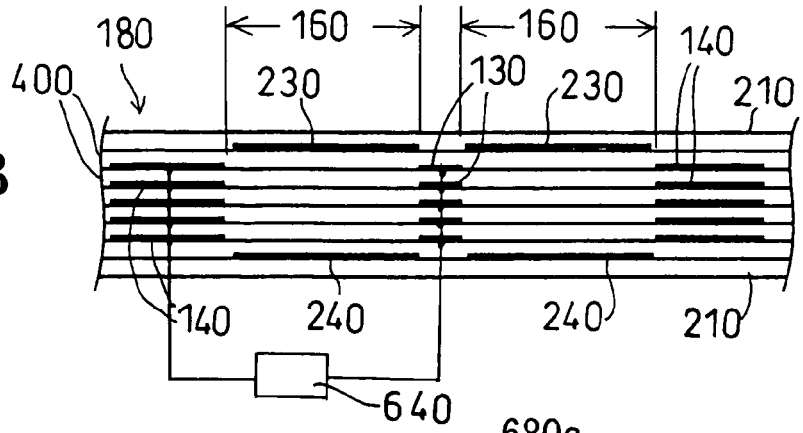
Figure 10C:
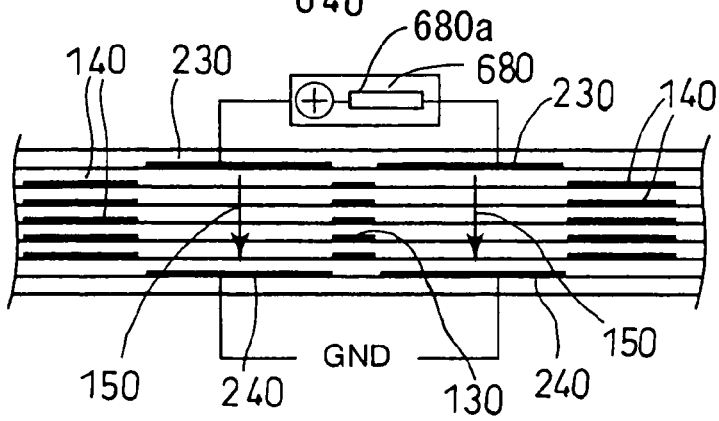

A second embodiment of the invention will be described with reference to FIGS. 10A–10C. As shown in FIG. 10A, inner electrodes 130 as a first set of electrodes and inner electrodes 140 as a second set of electrodes are provided alternately in a plurality of piezoelectric ceramic layers 400, at predetermined intervals, in the direction of an array of ink channels. In this embodiment, the first and second set of electrodes are stacked at predetermined intervals in the thickness direction of the piezoelectric ceramic layers 400. A pair of sets of inner electrodes 140, 140 are placed on partition walls (ink channel member 340) on both sides of each ink channel 320. A set of inner electrodes 320 is placed at the center of each ink channel 320.

Areas defined in the piezoelectric ceramic layers 400 between a set of inner electrodes 130 and a pair of sets of inner electrodes 140, 140 are polarized as active areas 160, 160, as shown by arrows 150. When an ink droplet is to be ejected selectively from an ink channel 320 based on predetermined print data, a pair of sets of inner electrodes 140, 140 on both sides of the ink channel 320 is grounded while a positive voltage (of +15 V, for example) is applied to a set of inner electrodes 130 at the center. Electric fields are generated, as shown by dotted arrows 170 in FIG. 10A, parallel to the plane of the piezoelectric ceramic layers 400. Active areas 160, 160 sandwiching a set of inner electrodes 130 at the center are deformed, as shown by dash-double-dot lines in FIG. 10A, obliquely by a symmetrical piezoelectric shear effect to shift the set of inner electrodes 130 away from the ink channel 320. As a result, the volume of the ink channel 320 is increased. At this time, ink is supplied from an ink source (not shown) to the ink channel 320. Thereafter, when the application of the drive voltage is stopped, the active areas 160, 160 return to the initial state. Thus, the volume of the ink channel 320 is reduced, and an ink droplet is ejected from the ink channel 320.

The piezoelectric transducer 180 is obtained similarly to the piezoelectric transducer 380 of the first embodiment. Inner electrodes 130, 140 are formed by screen-printing on an upper surface of each ceramic green sheet (piezoelectric ceramic layer 400) at predetermined positions to define active areas 160 therebetween. Such green sheets are laminated and, as shown in FIG. 10B, a green sheet 210 formed with polarizing electrodes 230 and a green sheet 210 formed with polarizing electrodes 240 are laminated to the top and bottom of the laminated green sheets 400, respectively. The laminated green sheets are thermally pressed, degreased, and sintered as required. Then, as shown in FIG. 10B, the capacitance measuring device 640 is connected to each pair of sets of inner electrodes 130, 140 of the piezoelectric transducer 180 to measure the capacitance of an active area 160 (area to be deformed by a piezoelectric shear effect) defined between the pair. The capacitance of each active area 160 (after the green sheets have been sintered and before they undergo polarization) is measured in the same manner as in the first embodiment. The measured capacitance of each active area 160 is stored and retained in the RAM of the controller 66.

Then, the piezoelectric transducer 180 is immersed in an oil bath filled with an insulating oil, such as a silicon oil, heated to a temperature of about 130° C., and polarization is performed for the piezoelectric transducer 180 immersed in the oil bath. As shown in FIG. 10C, by connecting a positive pole of the polarizing device 680 to polarizing electrodes 230, 230 via a voltage adjuster 680*a* of the polarization device 680 while grounding the corresponding polarizing electrodes 240, 240, the polarizing conditions, such as a polarization voltage to be applied, are adjusted for each active area 160 based on the measured capacitance. When two active areas 160, 160 sandwiching a set of inner electrodes 130 at the center have different capacitances, the average value should be used to set the polarization condition. Alternatively, each of the active areas 160, 160 may be polarized separately using a different condition. In this case, as described in the first embodiment, a data map or an expression representing the relationship between the capacitance and the polarization voltage, which has been obtained from FIG. 9, is previously stored in the controller 640. The polarization voltage to be applied is determined by a predetermined computation, and the adjuster of the polarizing device 680 is controlled accordingly. The piezoelectric ceramic layers 400 in the second embodiment are polarized, as shown by arrows 150 in FIGS. 10A and 10C, in the laminating (thickness) direction from the positive polarizing electrodes 230 toward the grounded polarizing electrodes 240.

After the completion of polarization, the top and bottom sheets 210 are removed by grinding together with the polarizing electrodes 230, 240.

Figure 11A:
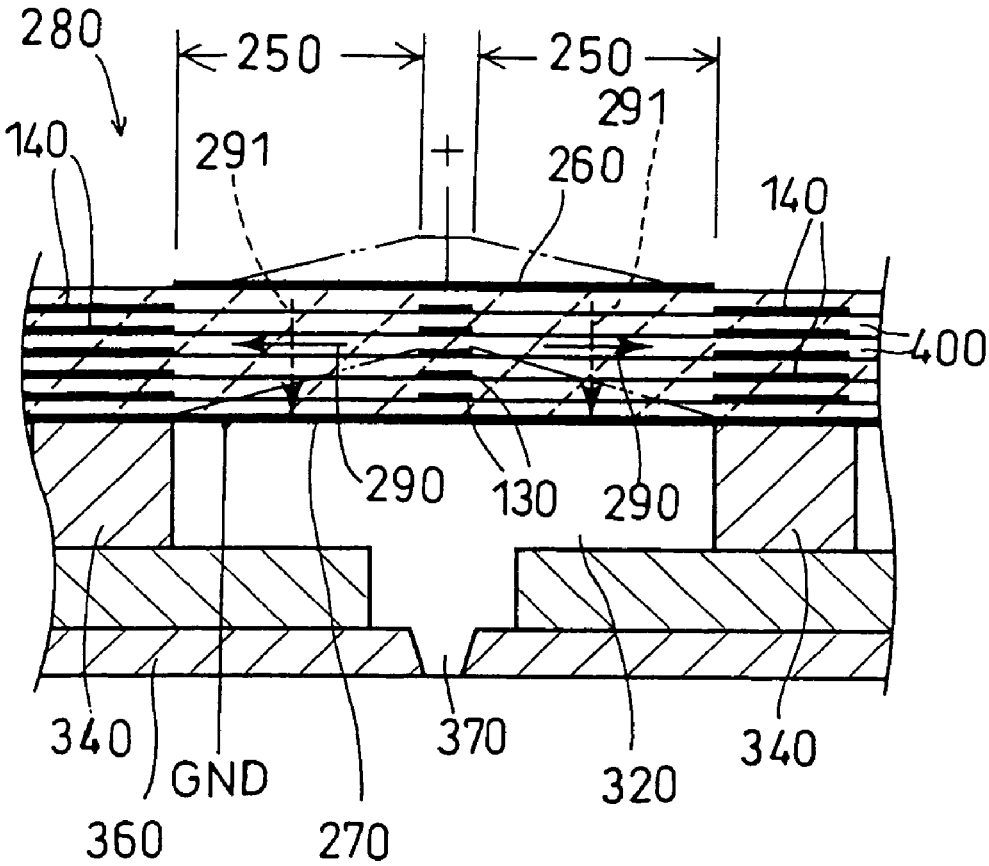
FIGS. 11A, 11B, and 11C show a third embodiment of the invention, FIG. 11A being a sectional view of an ink ejector, FIG. 1B showing the process of measuring the capacitance before polarization, and FIG. 11C showing the polarization process.
Figure 11B:
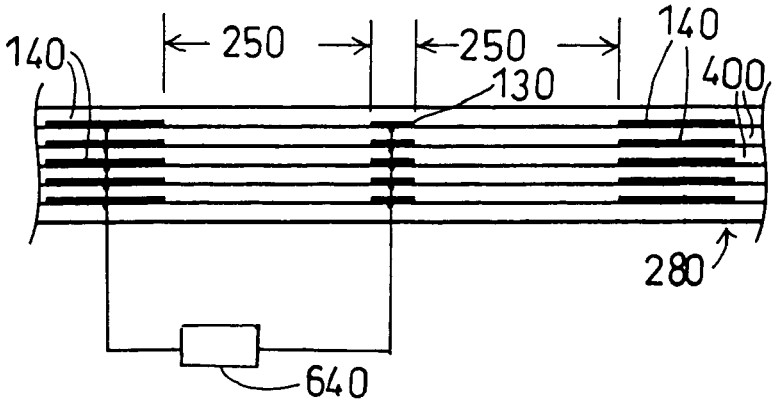
Figure 11C:
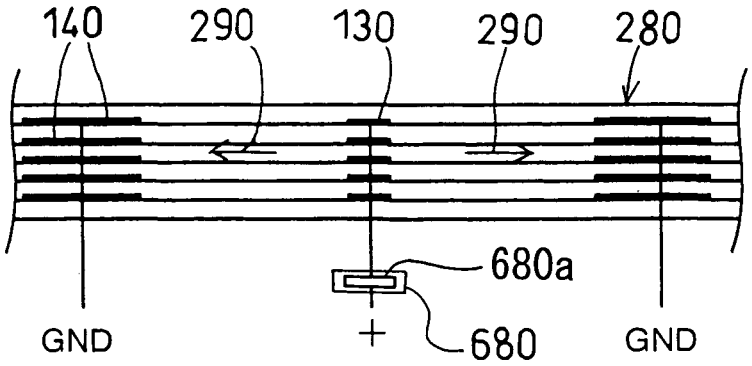
Figure 12:
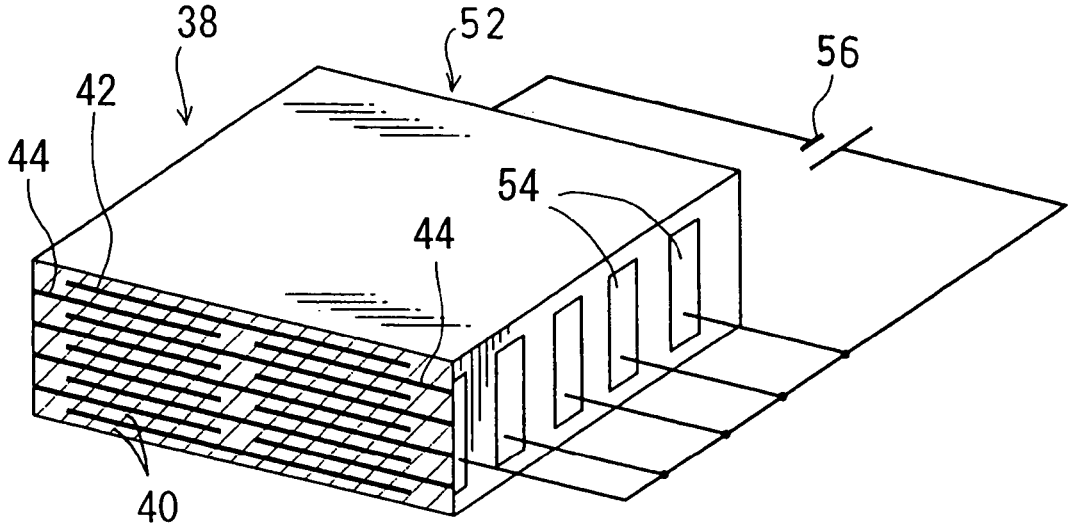
FIG.12 RELATED ART
FIG. 12 is a perspective view of a piezoelectric transducer polarized by a conventional method.

A third embodiment of the invention will be described with reference to FIGS. 11A, 11B, and 11C. A pair of sets of inner electrodes 140, 140 are placed on partition walls (ink channel member 340) on both sides of each ink channel 320. A set of inner electrodes 130 is placed at the center of each ink channel 320. In this case, sets of inner electrodes 130, 140 are used as polarizing electrodes. Each area defined between a set of inner electrodes 130 and a set of inner electrodes 140 is polarized as an active area 250, as shown by arrow 290, in an opposing direction of the sets of inner electrodes 130, 140.

Outer drive electrodes 260, 270 are formed on the outer surfaces of the top and bottom of the piezoelectric transducer 280. In this case, an outer common electrode 270 is formed throughout the bottom surface to face the ink channels 320, and outer individual electrodes 260 are formed separately to cover the respective active areas 250 of the respective ink channels 320.

When an ink droplet is to be ejected selectively from an ink channel 320 based on predetermined print data, the common electrode 270 are grounded while a positive voltage (of +15 V, for example) is applied to the outer individual electrode 260 provided for the ink channel 320. Electric fields are generated, as shown by dashed arrows 291, in the laminating (thickness) direction of the piezoelectric ceramic layers 400 (perpendicular to the polarization directions 290). Active areas 250, 250 sandwiching a set of inner electrodes 130 at the center are deformed, as shown by dash-double-dot lines in FIG. 11A, obliquely by a symmetrical piezoelectric shear effect to shift the set of inner electrodes 130 away from the ink channel 320. As a result, the volume of the ink channel 320 is increased. At this time, ink is supplied from an ink source (not shown) to the ink channel 320. Thereafter, when the application of the drive voltage is stopped, the active areas 250, 250 return to the initial state. Thus, the volume of the ink channel 320 is reduced, and an ink droplet is ejected from the ink channel 320.

In the third embodiment, also, the capacitance measuring device 640 is connected to each pair of sets of inner electrodes 130, 140 of the piezoelectric transducer 280 to measure the capacitance of an active area 250 (area to be deformed by a piezoelectric shear effect) defined between the pair. The capacitance of each active area 250 (after the green sheets have been sintered and before they undergo polarization) is measured in the same manner as in the first embodiment. The measured capacitance of each active area 250 is stored and retained in the RAM of the controller 66.

Then, the piezoelectric transducer 280 is immersed in an oil bath filled with an insulating oil, such as a silicon oil, heated to a temperature of about 130° C., and polarization is performed for the piezoelectric transducer 280 immersed in the oil bath. As shown in FIG. 11C, by connecting a positive pole of the polarizing device 680 to a set of inner electrodes 130 via a voltage adjuster 680*a* of the polarization device 680 while grounding a pair of sets of inner electrodes 140, 140 sandwiching the set of inner electrodes 130, the polarizing conditions, such as a polarization voltage to be applied, are adjusted for each active area 250 based on the measured capacitance.

When two active areas 250, 250 sandwiching a set of inner electrodes 130 at the center have different capacitances, the average value should be used to set the polarization condition. Alternatively, each of the active areas 250, 250 may be polarized separately using a different condition. As described in the first and second embodiments, a data map or an expression representing the relationship between the capacitance and the polarization voltage, which has been obtained from FIG. 9, is previously stored in the controller 640. The polarization voltage to be applied is determined by a predetermined computation, and the adjuster of the polarizing device 680 is controlled accordingly. The piezoelectric ceramic layers 400 in the third embodiment is polarized, as shown by arrows 290 in FIGS. 11A and 11C, parallel to the plane of the piezoelectric ceramic layers 400 from the positive polarizing electrodes 130 toward the grounded polarizing electrodes 140. In this embodiment, it is desirable that the outer electrodes 260, 270 are formed after the above-described polarization has been performed.

In the above-described embodiments, each active area of the piezoelectric transducer is polarized through the application of a polarization electric field having such an intensity that makes the active area to be deformed by a uniform amount when the polarized active area later receives a constant drive voltage. In other words, if polarization is performed by intensifying the polarization electric field when the capacitance of an active area is low and by weakening the polarization electric field when the capacitance of an active area is high, active areas thus polarized are to be deformed by a substantially uniform amount when operated later in an ink ejector. By adjusting the polarization electric field in inverse proportion to the capacitance, an ink droplet is ejected at a substantially uniform velocity from the ink channels 320.

The above-described method of polarizing the active areas of the piezoelectric transducer can also be applied to any combination of first, second, third embodiments, namely to a piezoelectric transducer having active areas to be deformed by a piezoelectric longitudinal effect and by a piezoelectric shear effect. Further, the method can also be applied to a piezoelectric transducer having only a single piezoelectric ceramic layer.

In the second embodiment, the capacitance between polarizing electrodes 230, 240 may be measured, instead of measuring the capacitance between a pair of sets of electrodes 130, 140. In the third embodiment, the capacitance between outer electrodes 260, 270 may be measured, instead of measuring a pair of sets of electrodes 130, 140. Further, in the second embodiment, the capacitance of two active areas 160, 160 may be measured collectively, and in the third embodiment, the capacitance of two active areas 250, 250 may be measured collectively.

In the piezoelectric transducer according to the above-described embodiments, each active area of the piezoelectric transducer is polarized through the application of a polarization electric field having such an intensity that makes the active area to be deformed by a substantially uniform amount when the polarized active area later receives a constant drive voltage. Thus, the active areas are deformed by a substantially uniform amount, even when the active areas vary in capacitance due to variations in thickness of the piezoelectric ceramic layers and variations in areas of the electrodes which occur during the manufacturing process. According to the principles of the present invention, variations in the amount of deformation that may be caused by uneven thickness of the piezoelectric ceramic layers and by uneven areas in the electrodes during the manufacturing process can be corrected by the subsequent polarization process. Thus, the manufacturing yields of piezoelectric transducers can be improved and the manufacturing costs can be reduced. Further, because there is no need to apply a different drive voltage separately to each active area, the costs of a power source or a driving circuit board can be reduced.

Accordingly, if the piezoelectric transducer of the invention is incorporated into an ink ejector, a substantially uniform volume of ink is ejected at a substantially uniform velocity from any of the ink channels.

While the invention has been described with reference to the specific embodiments, the description of the embodiments is illustrative only and is not to be construed as limiting the scope of the invention. Various other modifications and changes may be possible to those skilled in the art without departing from the spirit and scope of the invention.

What is claimed is:

1. An ink ejector comprising:

a plurality of ink channels filled with ink; and a piezoelectric transducer including:

at least one piezoelectric ceramic layer extending across the plurality of ink channels; and a plurality of sets of electrodes formed in the at least one piezoelectric ceramic layer, at predetermined intervals, in a direction along a plane of the piezoelectric ceramic layer, each set of electrodes including electrodes spaced in a thickness direction of the piezoelectric ceramic layer, and each set of electrodes defining therebetween an area to be deformed over a corresponding ink channel;

wherein a capacitance of each area to be deformed is measured, and each area to be deformed is polarized by adjusting a polarization condition based on the measured capacitance.

2. The ink ejector according to claim 1, wherein a polarization electric field to be applied to the area to be deformed is adjusted, as the polarization condition, in inverse proportion to the measured capacitance such that the polarization electric field is weakened when the measured capacitance of the area to be deformed is great and the polarization electric field is intensified when the measured capacitance of the area to be deformed is small.

3. The ink ejector according to claim 2, further comprising a voltage applying device that applies a constant drive voltage to each set of electrodes defining the area to be deformed, wherein when the voltage applying device applies the constant drive voltage to a selected set of electrodes defining the area to be deformed, the area to be deformed is deformed by a substantially uniform amount and ink is ejected at a substantially uniform velocity from a corresponding ink channel.

4. An ink ejector comprising:

a plurality of ink channels that store ink to be ejected; and a piezoelectric transducer including:

one or more piezoelectric ceramic layers overlying the plurality of ink channels and including a plurality of deformable areas with each being polarized and associated with one of the ink channels; and a plurality of sets of electrodes disposed in the piezoelectric ceramic layers at predetermined intervals, each set of electrodes including at least one positive electrode for applying a positive drive voltage and at least one reference electrode for applying a reference drive voltage, each set of electrodes defining therebetween an associated one of the deformable areas; and each of the deformable areas having a level of polarization that is based on individually measured capacitance of the each deformable area.

5. The ink ejector according to claim 4 wherein:

the plurality of sets of drive electrodes are formed in the one or more piezoelectric ceramic layers, at predetermined intervals, in a direction along a plane of the piezoelectric ceramic layers, each pair of sets of drive electrodes including adjacent sets of electrodes spaced in the direction along the plane, and each pair of sets of drive electrodes defining therebetween an area to be deformed over a corresponding ink channel; each area to be deformed being polarized in a direction perpendicular to an opposing direction of the adjacent sets of drive electrodes, wherein a capacitance of each area to be deformed is measured, and each area to be deformed is polarized by adjusting a polarization condition based on the measured capacitance.

6. The ink ejector according to claim 5, wherein a polarization electric field to be applied to the area to be deformed is adjusted, as the polarization condition, in inverse proportion to the measured capacitance such that the polarization electric field is weakened when the measured capacitance of the area to be deformed is great and the polarization electric field is intensified when the measured capacitance of the area to be deformed is small.

7. The ink ejector according to claim 6, further comprising a voltage applying device that applies a constant drive voltage to each pair of sets of drive electrodes defining the area to be deformed, wherein when the voltage applying device applies the constant drive voltage to a selected pair of sets of drive electrodes defining the area to be deformed, the area to be deformed is deformed by a substantially uniform amount and ink is ejected at a substantially uniform velocity from a corresponding ink channel.

8. The ink ejector according to claim 4 wherein:

the piezoelectric transducer further includes a plurality of drive electrodes formed in the at least one or more piezoelectric ceramic layers such that each pair of drive electrodes is opposed to each other in a direction perpendicular to an opposing direction of the pair of polarizing electrodes, each pair of opposed drive electrodes defining therebetween an area to be deformed over a corresponding ink channel, each area to be deformed being polarized in a direction perpendicular to an opposing direction of the opposed pair of drive electrodes, wherein a capacitance of each area to be deformed is measured, and each area to be deformed is polarized by adjusting a polarization condition based on the measured capacitance.

9. The ink ejector according to claim 8, wherein a polarization electric field to be applied to the area to be deformed is adjusted, as the polarization condition, in inverse proportion to the measured capacitance such that the polarization electric field is weakened when the measured capacitance of the area to be deformed is great and the polarization electric field is intensified when the measured capacitance of the area to be deformed is small.

10. The ink ejector according to claim 9, further comprising a voltage applying device that applies a constant drive voltage to each pair of opposed drive electrodes defining the area to be deformed, wherein when the voltage applying device applies the constant drive voltage to a selected pair of opposed drive electrodes defining the area to be deformed, the area to be deformed is deformed by a substantially uniform amount and ink is ejected at a substantially uniform velocity from a corresponding ink channel.

11. The ink ejector according to claim 4, wherein a polarizing electric field is applied to each deformable area and the level of the polarizing electric field varies in inverse proportion to the individually measured capacitance of the each deformable area.

12. The ink ejector according to claim 4, wherein the capacitance of each deformable area is measured between the corresponding set of electrodes and the level of polarization is inversely proportional to the individually measured capacitance.

13. The ink ejector according to claim 4, wherein the capacitance of each deformable area is measured between a set of polarizing electrodes and the level of polarization is inversely proportional to the individually measured capacitance.

* * * * *